US005779318A

United States Patent [19]

O'Reilly

[11] Patent Number: 5,779,318

[45] Date of Patent: Jul. 14, 1998

[54] COMBINATION HEARTH SEAT AND CHILD PROTECTOR

[76] Inventor: Edward Martin O'Reilly, 46 Klamberg Dr., Ellisville, Mo. 63021

[21] Appl. No.: 721,498

[22] Filed: Sep. 26, 1996

Related U.S. Application Data

[63] Continuation-in-part of Ser. No. 508,481, Jul. 28, 1995, abandoned.

[51] Int. Cl.[6] ..... A47B 95/04; A47C 7/18

[52] U.S. Cl. ..... 297/452.55; 297/452.59; 297/452.61; 297/DIG. 1; 248/345.1; 248/188.9; 108/27

[58] Field of Search ..... 297/452.55, 452.61, 297/452.59, 217.7, DIG. 1; 248/345.1, 615, 616, 188.9; 5/663, 424, 425; 108/27

[56] References Cited

U.S. PATENT DOCUMENTS

| | | | |
|---|---|---|---|
| 1,805,252 | 5/1931 | Miller . | |
| 1,824,923 | 9/1931 | Parsons . | |
| 2,699,567 | 1/1955 | Kramcsak, Jr. | 16/42 |
| 2,728,166 | 12/1955 | Molla | 45/137 |
| 3,025,557 | 3/1962 | Knowlton | 16/42 |
| 3,477,674 | 11/1969 | Schaller | 248/24 |
| 3,685,063 | 8/1972 | Morgan | 5/345 |
| 3,736,024 | 5/1973 | Woolard | 297/21 |
| 4,060,280 | 11/1977 | Van Loo | 297/452 |
| 4,077,665 | 3/1978 | Storch | 297/244 |
| 4,368,864 | 1/1983 | Tobey | 248/188.9 |
| 4,514,871 | 5/1985 | Fisher et al. | 5/508 |
| 4,714,163 | 12/1987 | Reeves | 248/345.1 X |
| 4,752,056 | 6/1988 | Culbertson | 248/188.9 |
| 4,795,215 | 1/1989 | Shimada | 297/452 |
| 4,867,135 | 9/1989 | Stecker | 126/500 |
| 4,903,686 | 2/1990 | Jennings | 126/500 |
| 5,050,583 | 9/1991 | Chapek et al. | 126/500 |
| 5,058,566 | 10/1991 | Dabbs et al. | 126/500 |
| 5,183,030 | 2/1993 | Woodward | 126/500 |
| 5,199,415 | 4/1993 | Johnson, Jr. | 126/500 |
| 5,508,078 | 4/1996 | Stalnaker | 248/345.1 X |
| 5,592,901 | 1/1997 | Birmingham | 248/345.1 X |

*Primary Examiner*—Peter M. Cuomo
*Assistant Examiner*—Rodney B. White
*Attorney, Agent, or Firm*—Herzog, Crebs & McGhee, LLP

[57] ABSTRACT

A combination hearth seat and child protector includes a rigid internal frame consisting of a top and front piece having a first layer of stiff foam adhered to the upper surfaces of the frame. A fire retardant material covers the foam and surrounds the entire frame. The protector is dimensioned to extend the entire long length of the hearth, while extending ¾ to ⅔ of the short length of the hearth from the edge opposite the firebox therein. In a second embodiment, the internal frame includes side pieces. A second layer of foam surrounds the first layer of foam and also extends about the underside of the end pieces. The fabric is then placed about the second layer of foam. The side pieces have a beveled end that fits over the sides of the hearth. The compression of the second foam layer and the beveled end pieces combine to create a compression or snap-on feature to keep the seat snugly thereon. The second layer of foam may extend about the underside of the front piece as well.

11 Claims, 3 Drawing Sheets

COMBINATION HEARTH SEAT AND CHILD PROTECTOR

CROSS-REFERENCE TO RELATED APPLICATIONS

This application is a continuation-in-part of patent application Ser. No. 08/508,481 filed Jul. 28, 1995 entitled COMBINATION HEARTH PROTECTOR AND SEAT, now abandoned of which the present inventor is a co-inventor.

FIELD OF THE INVENTION

The present invention relates to structures for covering the hearth and, more particularly, to a combination hearth seat and child protector.

BACKGROUND OF THE INVENTION

Many homes have a fireplace. Commonly, the fireplace is built into a wall of the house a distance from the ground. A hearth is constructed in front of the fireplace firebox and is usually made from bricks, stone, or other masonry product. The hearth may be any shape, however, most are rectangular with the long side of the rectangle extending adjacent and along the wall. The hearth thus extends a distance from the firebox and wall. Additionally, the hearth extends upward from the floor.

Because of the masonry construction, the hearth is very hard and the edges are very sharp. The unprotected hearth can be a source of personal injury to those who fall into or forcefully hit the top, sides or edges of the hearth. In the case of infants and children, the hearth poses a risk in that they do not have the coordination to prevent falling onto the hearth or appreciate the consequences of such action. Children will play too close to the hearth.

In order to provide some protection for the person falling or forcibly contacting the hearth, various devices have been constructed. One such type is the edge only or rail type cover.

U.S. Pat. No. 4,903,686 Jennings, issued Feb. 27, 1990, is an example of the rail or edge covering type hearth protector. A right angle frame rests on the three exposed edges of the hearth, thereby protecting only the edges. A padded material surrounds the outside of the frame with an outer material surrounding the padding and connected to the inner surface of the frame.

While the '686 device protects one from the edges of the hearth, almost the entire top surface of the hearth remains unprotected. Also, the '686 device does not define a seat, nor is it aesthetically pleasing.

Both U.S. Pat. No. 5,058,566 Dabbs et al., issued Oct. 22, 1991 and U.S. Pat. No. 5,199,415 Johnson, Jr., issued Apr. 6, 1993, are further examples of rail or edge only type hearth protection devices. Each of these devices includes an adjustment mechanism for fitting the rail onto various sized hearths. Again, these devices fail for the same reasons as the '686 device.

U.S. Pat. No. 5,183,030 Woodward, issued Feb. 2, 1993, also only covers the edges of the hearth. Additionally there is no internal frame for making the device rigid. The '030 patent is only a comforter having an interior batting material. It is likewise unsuitable as an effective hearth child protector and bench seat.

U.S. Pat. No. 4,867,135 Stecker, issued Sep. 19, 1989, is a hearth protection pad. The pad does not have an internally rigid structure, but consists of foam covered by a covering material. A plurality of pads are coupled together by Velcro®, snaps, or zippers. Together the pads form a complete cover for the hearth.

In U.S. Pat. No. 3,736,024 Woolard, issued May 29, 1973, a chair is disclosed for covering the opening of the fireplace. The chair extends about a portion of the hearth in front of the fireplace. Because the left and right ends of the hearth are still exposed, the chair does not provide total protection from injury.

It is evident from the foregoing, that the prior art devices do not provide adequate protection from forcible contact with the major portion of the hearth, including the edges. Furthermore these devices are relatively easily knocked off or removed from the hearth and are not aesthetically pleasing. Additionally none of the prior art devices provide an additional seat for the room while providing contact protection.

It is therefore an object of the present invention to provide a protection device to mitigate against injury occurring during forcible contact with the hearth and provide a useable extra seat for the room.

It is further an object of the present invention to provide the above-described protector that is aesthetically pleasing.

It is another object of the present invention to provide a combination hearth seat and child protector that will not be easily knocked off from the hearth.

SUMMARY OF THE INVENTION

The present invention is a combination hearth seat and child protector. The protector includes a rigid internal frame having a preferably fire retardant foam material adhered to the upper surface of the frame. A preferably fire retardant fabric covers the foam and surrounds the entire frame. The protector is dimensioned to extend the entire long length of the hearth, while extending ¾ to ⅞ of the short length of the hearth from the edge opposite the firebox therein.

In one embodiment, the protector seat includes a wood or particle board frame constituting the rigid internal frame consisting of two pieces joined at right angles. A rectangular top piece is dimensioned to cover the top surface of the hearth as described above, while a longitudinal front piece extends downwardly a short distance from the front edge of the hearth. A stiff foam is glued to the upper surface of the top piece and the front piece. A fire retardant fabric covers the foam and also wraps around the protector seat to also cover the entire underside of the frame. Cushioned feet are attached to the underside of the frame for resting on the hearth surface.

In a second embodiment, the protector further includes an end piece attached to each longitudinal end of the rectangular top piece. Each end piece extends downwardly a short distance along the sides in like manner to the front piece. The side pieces have a rigid internal frame consisting of wood or particle board with a beveled end. The foam that covers the top surfaces of the top and front pieces also covers the top surface of each end piece.

A second layer of foam covers the first layer of foam and the bottom surface of the frames of each side piece. The fabric again surrounds the entire protector. The combination of the beveled edge and second layer of foam compressed by the sides of the hearth when place thereon, provides a compressed or snap-on fit of the protector seat onto the hearth. Preferably, the top piece of the frame is dimensional so as to maximize the compression and thus the holding of the seat onto the hearth.

The present invention enhances the fireplace hearth rather than detracting from the hearth by being aesthetically pleasing while affording child protection in conjunction with providing an extra seat in the room.

BRIEF DESCRIPTION OF THE DRAWINGS

So that the manner in which the above-recited features, advantages, and objects of the present invention are attained and can be understood in detail, a more particular description of the invention, briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments. Reference the appended drawings, wherein.

DETAILED DESCRIPTION

Figure 1:
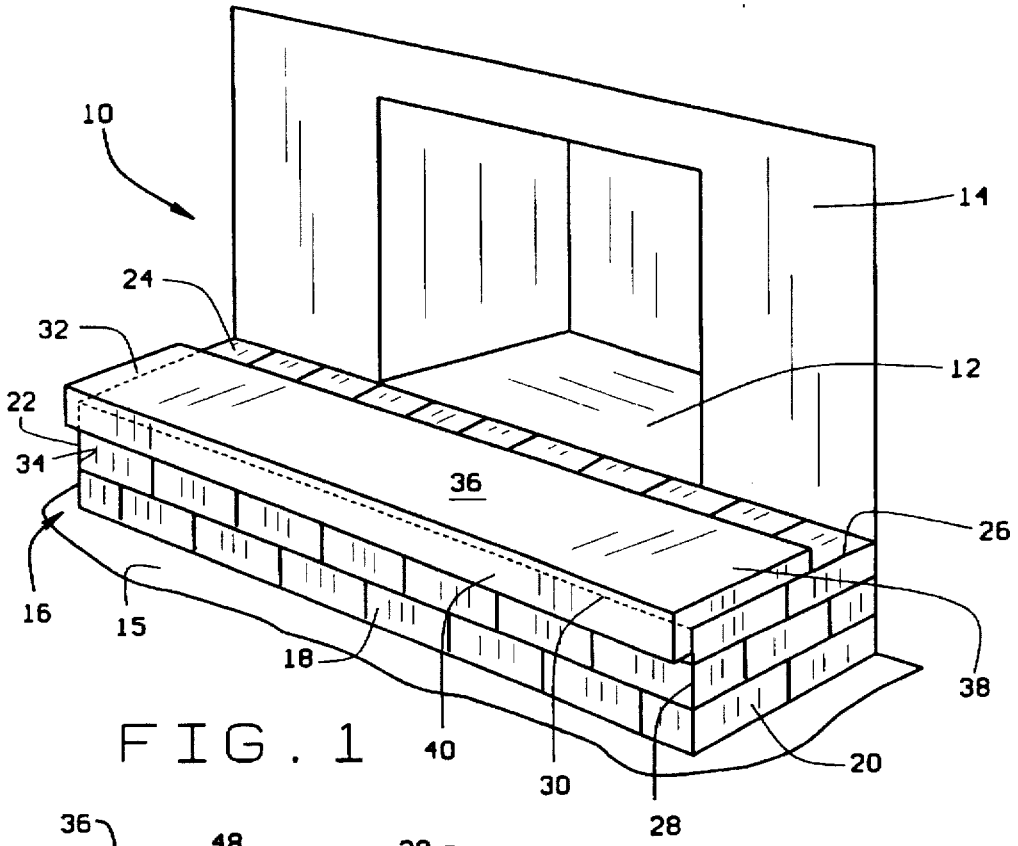
FIG. 1 is an elevational view of a typical fireplace and hearth with an embodiment of the present invention.

Referring now to FIG. 1, a typical fireplace is shown generally designated 10. The fireplace 10 is defined by a firebox 12 that is set into a wall 14. As is typical, the firebox 12 is set in the wall a distance upwards from the floor 15. In front of the firebox 12 is a hearth 16 resting on the floor 15. The hearth 16 is shown as being built from bricks, although the present invention is equally usable with all types of hearths, masonry or otherwise.

The hearth 16, as shown, is rectangular and defines a front side 18, a right side 20, a left side 22 and a top or upper surface 24. Again, as is typical, the top surface 24 is essentially level with the floor of the firebox 12. The right side 20 along with the top 24 defines a top right edge 26 that is the short side of the rectangular hearth 16. The right side 20 along with the front side 18 defines a front right vertical edge 28. The top 24 along with the front side 18 defines a front longitudinal edge 30. The left side 22 along with the top 24 defines a left top edge 32, while the left side 22 along with the front side 18 defines a front left vertical edge 34. It is thus evident from the above that the hearth naturally includes many sharp edges. Even if the shape of the hearth is not rectangular, the present seat may be modified accordingly.

A hearth seat and child protector generally designated 36 is shown resting on the hearth 16. The protector 36 has a rectangular top 38 that corresponds in longitudinal length to the longitudinal length of the hearth 16. The top 38 of the protector 36 is also preferably dimensioned to extend ⅔ to ¾ of the short length of the hearth 16 from the front edge 30 towards the firebox 12. It should be understood that the top 38 may entirely cover the top surface 24 of the hearth 16, but should not be any less than ½ of the short length. In the case where the entire top surface 24 of the hearth 16 is not covered, the exposed rear portion of the top surface 24 near the firebox 12 may be used to place fireplace tools (not shown) and other fireplace or decorative objects (not shown).

The protector 36 also includes a front portion 40 that is attached to and forms a right angle with the front face of the top portion 38. The front portion 40 extends the entire longitudinal length of the hearth 16 and downward a distance therefrom towards the floor 15. Of course, the downward length of the front portion 40 may be variable, but for aesthetics, is preferably a brick or two in height. It can thus be appreciated that the front portion 40 along with the top 38 encloses or covers the front edge 30. Additionally, the top portion 38 along with the front portion 40 does not allow the striking of the right edge 26 or the left edge 32 along the dimensions of the two portions 38, 40.

Figure 2:
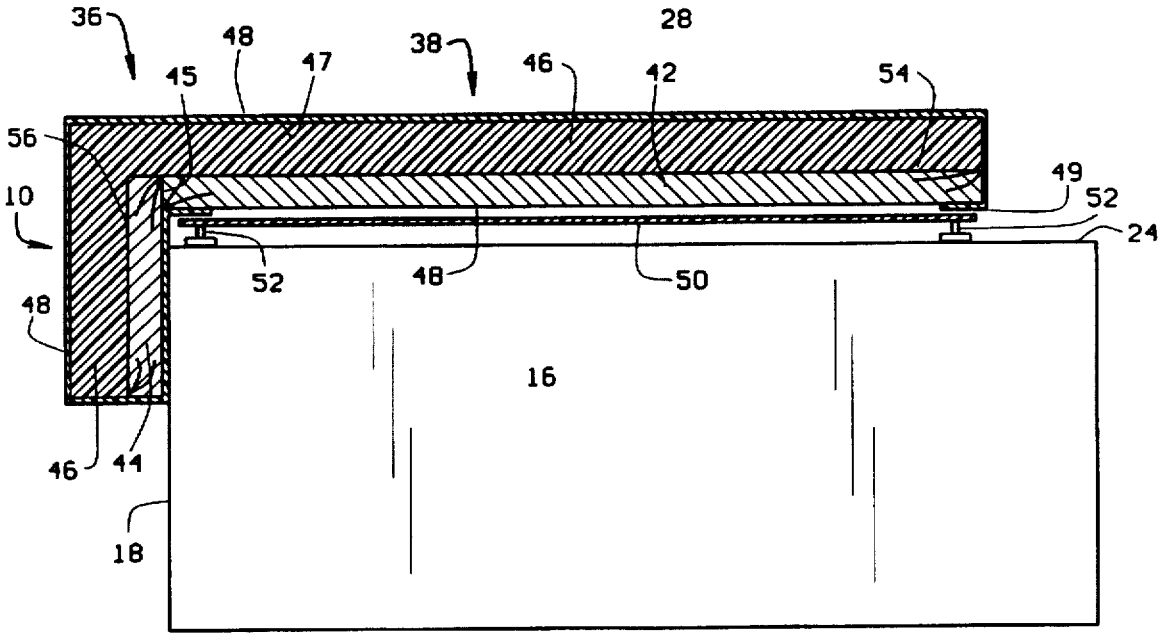
FIG. 2 is an enlarged cross-section view of the present invention of FIG. 1.

Referring now in particular to FIG. 2, there is shown the protector 36 in cross-section resting on the hearth 16. The protector 36 includes a rigid internal frame consisting of a top rectangular board 42 and a front board 44. Preferably the boards 42, 44 are ⅝" particle board, plywood or similar material with the top board 42 being 14" in width and the front board 44 being 4" in width for a standard hearth. However, as stated above, these dimensions may change within the above-identified parameters without departing from the spirit and intent of the present invention. The front board 44 is attached to the end 45 of the top board 42 so as to form a downward right angle.

Applied to the upper surface 54 of the top board 42 and to the upper surface 56 of the front board 44 is a glue or adhesive (not shown). Preferably, the adhesive is a non-flammable, high solids synthetic rubber glue that has a fast evaporating solvent so as to offer a fast tack or dry time. Such a glue would be a Camie #313B Liquid Syphon Spray Glue. Applied to the adhesive is a layer of one (1) inch stiff foam 46. A stiff foam is utilized to offer better cushioning than a soft foam can provide. Preferably, the foam is a high density firm foam (HDXFR) that is additionally flame-retardant.

A second layer of adhesive (not shown) of the same type identified above, is applied to the upper surface 47 of the foam 46. A fabric or cover 48 is placed onto the glue on the upper surface 47 and wrapped completely around the boards 42, 44 such that no portion of the boards 42, 44 is exposed. Preferably, the fabric is a flame retardant, colorfast material. It should be noted that other flame retardant materials may be utilized, however, fabric generally presents a better finished product. The fabric 48 is stapled to the underside 49 of the top board 42 along with a FLEX-TRIM (PLI-GRIP) continuous-strip "invisible" steel fastener 50. The fastener 50 hides the staples to present an aesthetically pleasing bottom to the protector 36.

Figure 3:
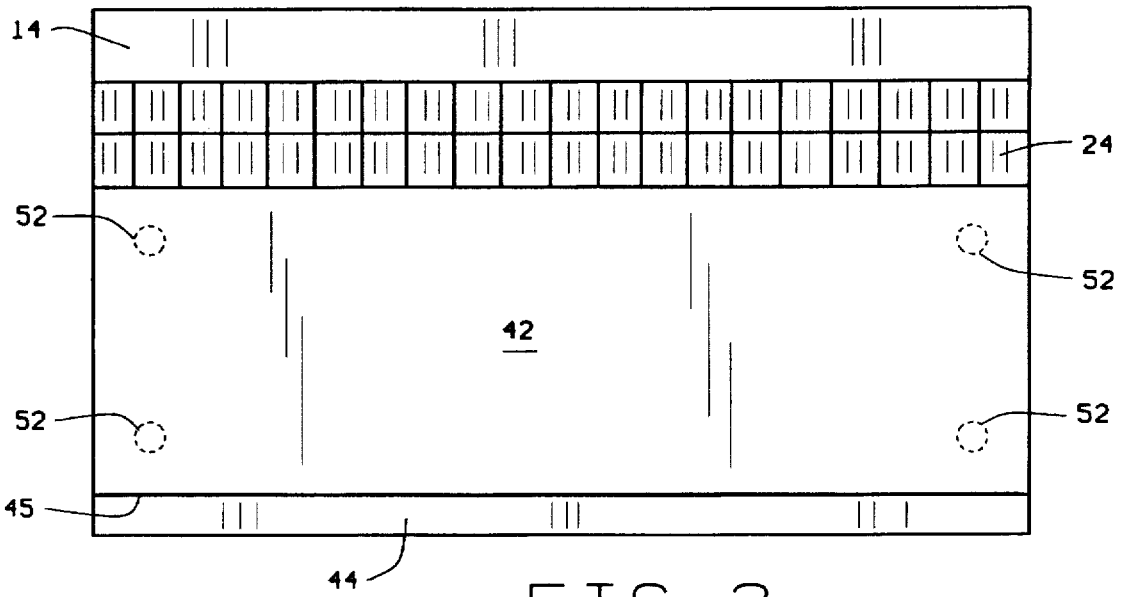
FIG. 3 is a top view of the rigid frame of the present invention of FIG. 1, the padding and fabric being removed.

Four (4) cushioned legs or glides 52 are attached to the four corners of the underside 49 of the top board 42. Such glides 52 may be a nickel-plated case-hardened steel base rubber-cushioned glide. The placement of the glides 52 and the front board 44 relative to the top board 42 is best illustrated in FIG. 3.

Alternatively, a layer of DACRON fiber material may be added between the foam and the covering material. A one inch (1") layer gives the seat a more puffy look. Also, the foam padding may consist of multiple layers of different stiffness foam such as ½" of stiff foam and ½" of soft foam.

Figure 4:
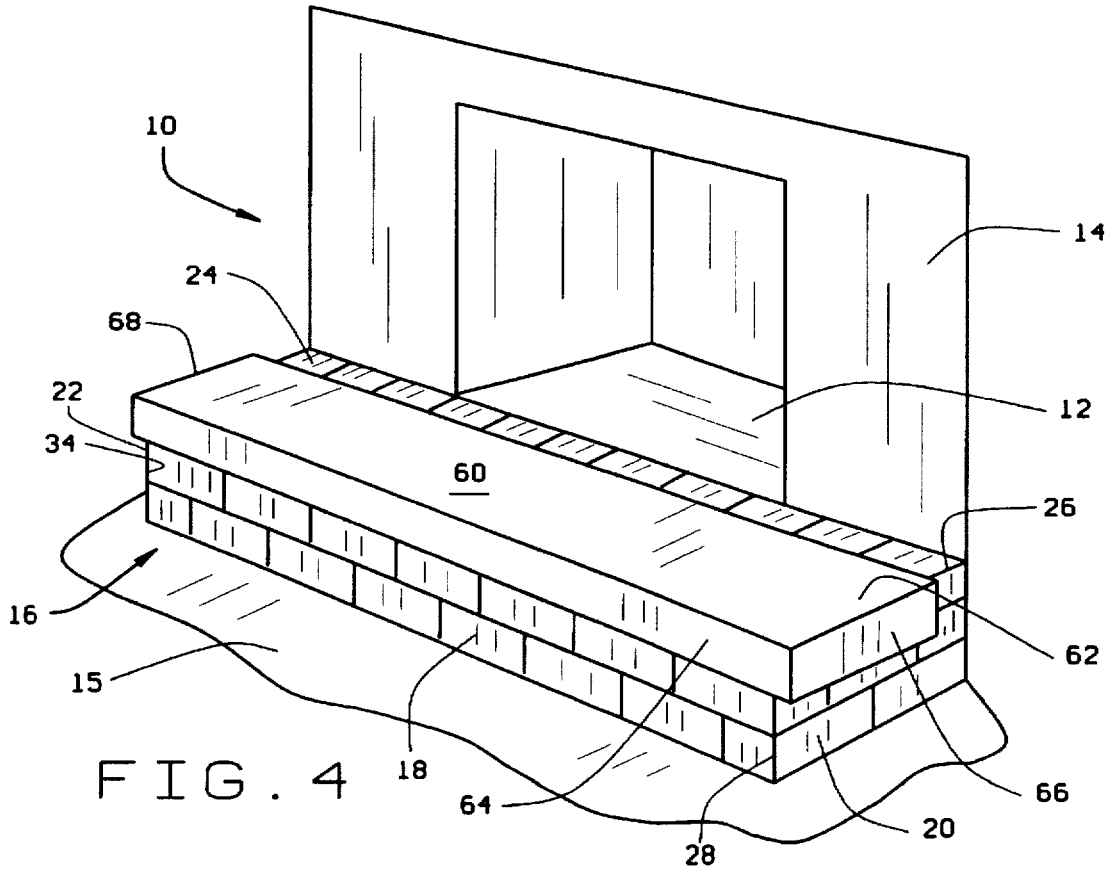
FIG. 4 is an elevational view of a typical fireplace and hearth with a second embodiment of the present invention.

Referring now to FIG. 4, there is again shown the fireplace 10, having the firebox 12 in a wall 14, with the hearth 16 upon the floor 15, but with a second embodiment of a hearth seat and child protector generally designated 60 fitted upon the top surface 24 of the hearth 16. The seat 60 has a top 62, a front 64, a right side 66, and a left side 68. Again, the top 62 rests upon the upper surface 24 of the hearth 16 and covers ⅔ to ¾ of the upper surface 24 of the hearth, extending from the front of the hearth towards the firebox 12. In this embodiment, the seat 60 is compress-fitted or snap-fitted onto the hearth 16, as described in detail hereinbelow. Because of this fit, the seat 60 is snugly retained on the hearth; resisting movement thereof.

Connected to the top 62 at a front edge thereof and at a generally right angle thereto is a front piece 64. The front piece 64 extends a distance downward along the front 18 of the hearth 16 and slightly beyond its longitudinal length. On the right side of the top 62 is a right side member 66 attached at a generally right angle to the right side edge of the top 62. Like the front piece 64, the right piece 66 extends downward to a portion of the right side 20 of the hearth 16. Although not generally discernible in FIG. 4, a left side piece 68 is identical to the right side piece 66. In this embodiment, the seat 60 covers substantially the entire edge of the hearth, the top surface of the hearth 24, and a portion of the front and left and right sides.

Figure 5:
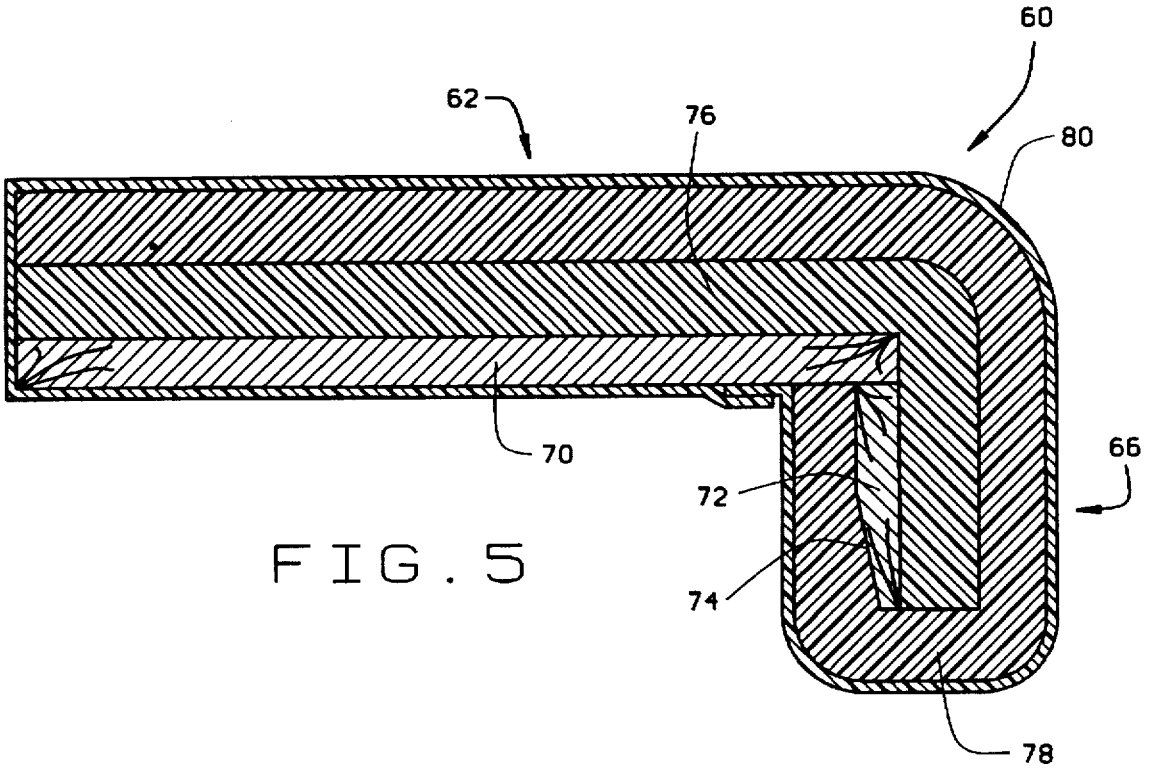
FIG. 5 is an enlarged, partial, cross-section view of one side of the embodiment depicted in FIG. 4 before placement on the hearth.

With reference to FIG. 5, the construction of the seat 60 is depicted. However, it should be noted that only a portion of the top 62 and just the right side 66 is shown. The construction of the left side 68 is identical to the right side 66. Therefore, only the right side 66 will be described, but it should be understood that the left side 68 is identical in form and construction.

Again, the seat 60 includes an internal rigid frame consisting of a top board 70 to which is coupled a right side board 72 at a right end thereof. Board 72 is generally perpendicular to board 70 and extends a short downward distance. Additionally, the board 72 includes a taper 74 that facilitates that placement of the seat 60 onto the hearth 16 and, as further described hereinbelow, constitutes along with other features the compression or snap-fitting mechanism. Attached to the upper surface of the board 70 is a first layer of foam 76 preferably a rigid foam. The foam wraps around the edge of the board 70 and also extends and is attached to the top surface of the right board 72. A second layer of foam 78 preferably a soft foam is disposed on top of and attached to the first foam layer 76. In addition, the second foam layer 78 wraps around the right board 72 and first foam layer 76 and is attached to the under or lower side of the right board 72 up to the under or lower surface of the board 70. Extending about the foam layers and the entire seat 60 is a fabric layer 80.

Figure 6:
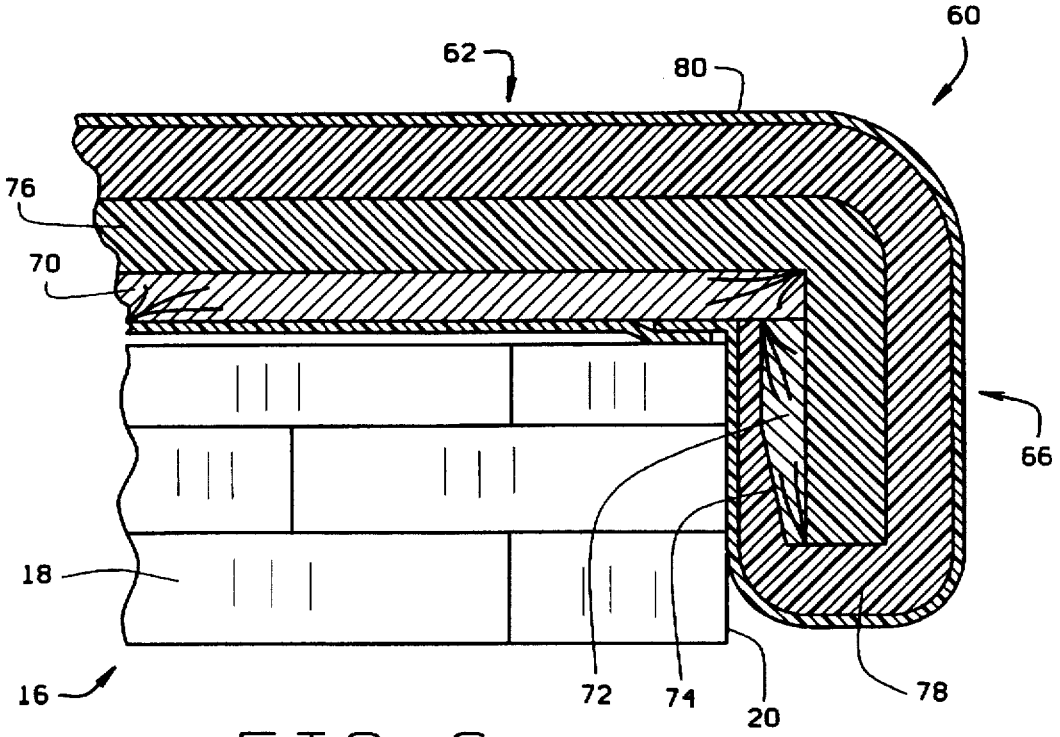
FIG. 6 is an enlarged, partial, cross-section view of one side of the embodiment depicted in FIG. 4 after placement on the hearth.

With specific reference to FIG. 6, the seat 60 is shown placed on the hearth 16. The top 62 is dimensioned to extend a distance beyond the edge 20 of the hearth 16 such that when the seat 60 is placed onto the hearth, the second foam layer 78 and taper 74 cooperate to provide a compression of the foam layer 78 such that the seat 60 fits snugly onto the hearth 16. While the front 64 does not need the second layer of foam 68, it may be placed thereon.

It can be thus appreciated from the foregoing that the present protector is not only a child protector for the hearth, but is a fully functional piece of furniture in the nature of a bench seat. The protector allows the use of the fireplace while adding a measure of protection against forceful contact with the hearth. At the same time extra seating is gained in the room without taking up additional floor space.

While the foregoing is directed to the preferred embodiments of the present invention, still other and further embodiments of the invention may be devised without departing from the basic scope thereof, and the scope thereof is determined by the claims which follow.

What is claimed is:

1. A combination hearth seat and child protector comprising:

a rigid frame defined by a top piece, a front piece, a left side piece, and a right side piece, said front piece attached to a front edge of said top piece and extending a distance downward, said left side piece attached to a left edge of said top piece and extending a distance downward, said right side piece attached to a right edge of said top piece and extending a distance downward, said top piece adapted to rest on a top surface of the hearth, said left side piece adapted to cover a portion of the left side of the hearth, said right side piece adapted to cover a portion of the right side of the hearth, and said front piece adapted to cover a portion of the front of the hearth;

a first foam layer disposed on an upper surface of said top piece, and upper surface of said front piece, an upper surface of said right side piece, and an upper surface of said left side piece;

a second foam layer disposed on said first foam layer and on a lower surface of said left side piece and on a lower surface of said right side piece;

a layer of fabric disposed on said second foam layer and a lower surface of said front piece and a lower surface of said top piece; and wherein said top piece is adapted to cover a substantial portion of the top surface of the hearth, said substantial portion equal to or greater than ⅔ of the top surface of the hearth from a front edge thereof towards a rear edge thereof, and an entire length of the top surface of the hearth from a right side to a left side thereof.

2. The combination hearth seat and child protector of claim 1, wherein said front piece is substantially perpendicular to said top piece, said left piece is substantially perpendicular to said top piece, and said right piece is substantially perpendicular to said top piece.

3. The combination hearth seat and child protector of claim 1, wherein said first foam layer is a rigid foam and said second foam layer is a soft foam.

4. The combination hearth seat and child protector of claim 1, wherein said left side piece has a tapered end, and said right side piece has a tapered end.

5. The combination hearth seat and child protector of claim 1, wherein said first and second foam layers and said fabric layer are fire retardant.

6. The combination hearth seat and child protector of claim 1, wherein said first foam layer is glued on the respective upper surfaces, said second foam layer is glued thereover, and said fabric layer is stapled thereon.

7. The combination hearth seat and child protector of claim 1, further comprising:

a plurality of legs attached to a lower surface of said top piece over said fabric layer.

8. A combination hearth seat and child protector comprising:

a rigid frame defined by a top member, a front member attached to a front edge of said top member, a left side member attached to a left edge of said top member, and a right side member attached to a right edge of said top member, said top member adapted to rest on a top surface of a hearth, said front member adapted to extend along a front surface of the hearth, the right member adapted to extend along a right surface of the hearth, and the left side member adapted to extend along a left surface of the hearth;

a rigid foam layer disposed on an upper surface of said top member, said front member, and said left and right members;

a soft foam layer disposed on said rigid foam layer, a lower surface of said right member, and a lower surface of said left member;

a layer of fabric disposed on said soft foam layer, a lower surface of said top member, and a lower surface of said front member; and wherein said top piece is adapted to cover a substantial portion of the top surface of the hearth, said substantial portion equal to or greater than ⅔ of the top surface of the hearth from a front edge thereof towards a rear edge thereof, and an entire length of the top surface of the hearth from a right side to a left side thereof.

9. The combination hearth seat and child protector of claim 8, wherein said right member has a tapered end opposite said right edge of said top member and said left member has a tapered end opposite said left edge of said top member.

10. The combination hearth seat and child protector of claim 8, wherein said front member, said right member, and said left member are attached at right angles to said top member.

11. The combination hearth seat and child protector of claim 8, further comprising:

a plurality of glides attached at lower surface corners of said top member, over said layer of fabric.

* * * * *